US008888521B2

(12) United States Patent
Puckett et al.

(10) Patent No.: US 8,888,521 B2
(45) Date of Patent: Nov. 18, 2014

(54) IN-LINE SEALED ELECTRICAL CONNECTOR APPARATUS HAVING A CONNECTOR APPARATUS POSITION ASSURANCE DEVICE, AND LOCKING METHOD THEREOF

(75) Inventors: John Jeffrey Puckett, Ypsilanti, MI (US); Makiko Brzezinski, Santa Clara, CA (US); Charles Paul Depp, Ann Arbor, MI (US)

(73) Assignee: J.S.T. Corporation, Farmington Hills, MI (US)

( * ) Notice: Subject to any disclaimer, the term of this patent is extended or adjusted under 35 U.S.C. 154(b) by 126 days.

(21) Appl. No.: 13/495,461

(22) Filed: Jun. 13, 2012

(65) Prior Publication Data

US 2013/0337677 A1 Dec. 19, 2013

(51) Int. Cl.
*H01R 13/625* (2006.01)

(52) U.S. Cl.
USPC ..... 439/352

(58) Field of Classification Search
USPC ..... 439/352, 347, 350, 357
See application file for complete search history.

(56) References Cited

U.S. PATENT DOCUMENTS

| | | | | |
|---|---|---|---|---|
| 3,986,765 | A * | 10/1976 | Shaffer et al. | 439/314 |
| 6,056,577 | A * | 5/2000 | Blanchet | 439/352 |
| 7,465,192 | B2 | 12/2008 | McKenzie et al. | |
| 8,235,744 | B1 * | 8/2012 | Liptak et al. | 439/352 |

* cited by examiner

*Primary Examiner* — Phuong Dinh
(74) *Attorney, Agent, or Firm* — Kratz, Quintos & Hanson, LLP

(57) ABSTRACT

A connector apparatus position assurance device ensures that a male connector assembly and a female connector assembly of an in-line sealed electrical connector apparatus of the present invention remain engaged. The connector apparatus position assurance device has contiguous parts that engage various parts of a retention clip of the male connector assembly at different levels of insertion of the connector apparatus position assurance device into the male connector assembly. The insertion of the connector apparatus position assurance device is also accomplished at various stages (i.e., from pre-lock position to final lock position) depending on the insertion level of the female connector assembly into the male connector assembly. Consequently, the effect of the level of insertion of the female connector assembly ensures that the male and female connector assemblies remain engaged.

14 Claims, 8 Drawing Sheets

IN-LINE SEALED ELECTRICAL CONNECTOR APPARATUS HAVING A CONNECTOR APPARATUS POSITION ASSURANCE DEVICE, AND LOCKING METHOD THEREOF

BACKGROUND OF THE INVENTION

1. Field of the Invention

The present invention generally relates to an in-line sealed electrical connector apparatus having a connector apparatus position assurance device, and a locking method thereof. More particularly, this invention is directed to the connector apparatus position assurance device having contiguous parts for ensuring the engagement of the male and female connector assemblies of the in-line sealed electrical connector apparatus, and a locking method thereof.

2. Discussion of the Relevant Art

U.S. Pat. No. 7,465,192 is directed to an inline electrical connector apparatus that has a female connector assembly, the female connector assembly having a female housing, a female wire seal, and a female cover. The in-line sealed electrical connector of U.S. Pat. No. 7,465,192 further has a male connector assembly, the male connector assembly having a male housing, a retention clip, a male housing seal defining a male housing seal opening, a male wire seal, and a male cover. The female connector assembly is inserted within the male connector assembly, the female connector assembly being latched into the male connector assembly.

When the in-line electrical connector apparatus is in use, a first wire assembly is connected to the female connector assembly, while a second wire assembly is connected to the male connector assembly.

However, in the in-line electrical connector apparatus of U.S. Pat. No. 7,465,192, there is no assurance that the male housing assembly and the female housing assembly remain engaged and locked.

SUMMARY OF THE INVENTION

To ensure that the male housing assembly and the female housing assembly of the in-line sealed electrical connector apparatus of the present invention remain engaged and locked, a connector apparatus position assurance device is employed. The connector apparatus position assurance device has contiguous parts that engage various parts of the retention clip of the male connector assembly at different levels of insertion of the connector apparatus position assurance device into the male connector assembly. The insertion of the connector apparatus position assurance device is also accomplished at various stages (e.g., from pre-lock position to final lock position) dependent on the insertion level of the female connector assembly into the male connector assembly. For example, the effect of the level of insertion of the female connector assembly on various parts of the retention clip in turn affect the insertion of the connector apparatus position assurance device into the male connector assembly (i.e., from pre-lock position to final lock position). Also, if, e.g., the connector apparatus position assurance device happens to be fully inserted and in the final lock position, without the female connector assembly having been fully mated with the male connector assembly, the female connector assembly cannot be inserted into the male connector assembly.

Once fully inserted, the connector apparatus position assurance device ensures the locking engagement of the male and female connector assemblies of the in-line sealed electrical connector apparatus of the present invention. This is accomplished by the connector apparatus position assurance device of this invention ensuring that the retention clip of the male connector assembly fully locks therein the female connector assembly.

DETAILED DESCRIPTION OF THE PREFERRED EMBODIMENTS

Figure 1:
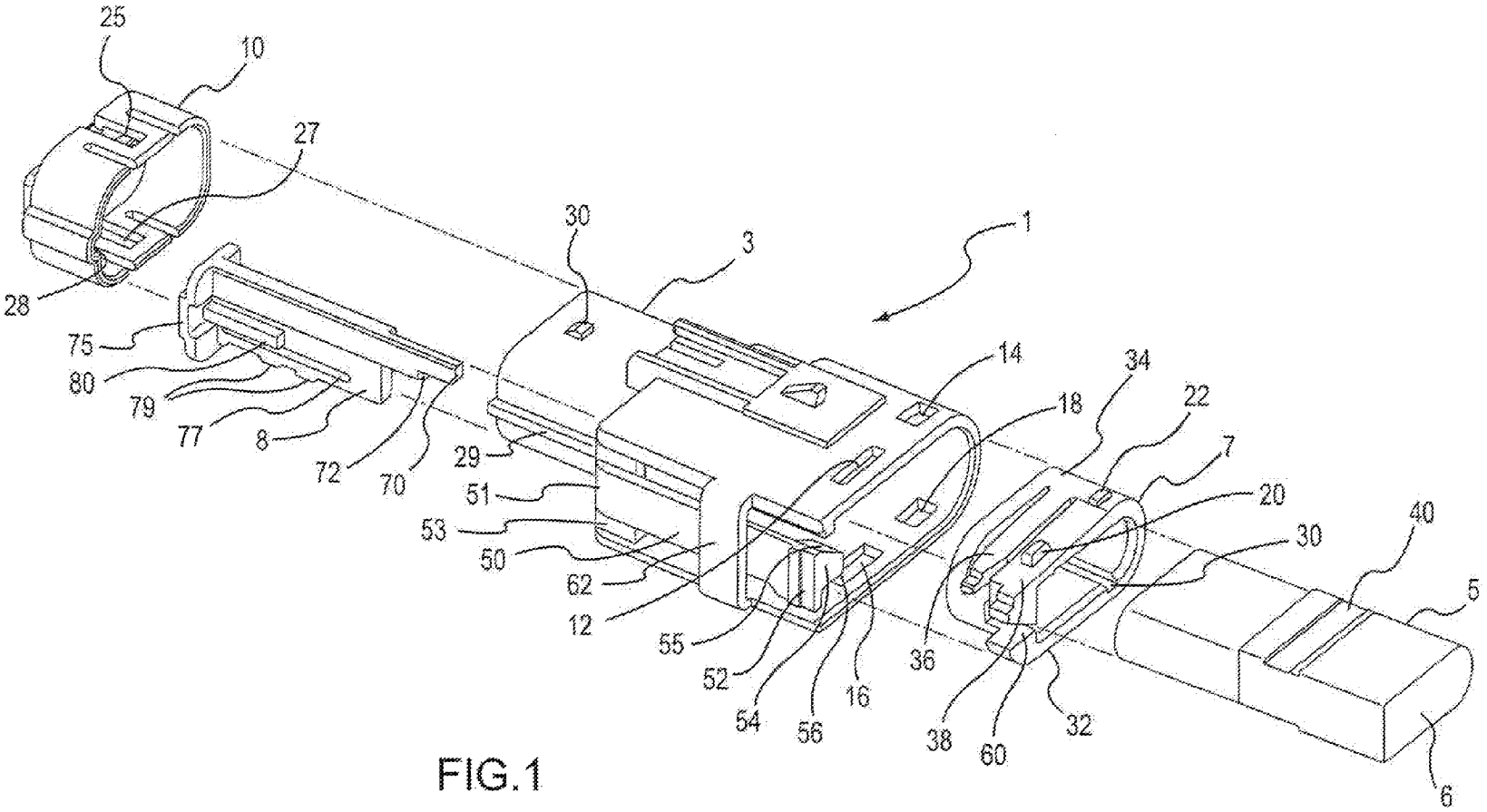
FIG. 1 is an exploded perspective view of the in-line sealed electrical apparatus having a connector apparatus position assurance device of the present invention.

FIG. 1 is an exploded view showing the in-line sealed electrical connector apparatus of the present invention, generally referred to as reference number 1. The in-line electrical connector apparatus 1 includes a male connector assembly 3 and a female connector assembly 5. Mounted within the male connector assembly 3 is a retention clip 7 for receiving therein the female connector assembly 5. Shown in FIG. 1 is a connector apparatus position assurance device 8 insertable into the male connector assembly 3 and the retention clip 7. The male connector assembly 3 has, at an end portion thereof; a cover 10. A wire assembly (not shown) can be inserted into the male connector assembly 3 through openings (not shown) passing through the cover 10; and another wire assembly (not shown) can similarly be inserted into the female connector assembly 5 through openings (not shown) at a free end 6 thereof.

The male connector assembly 3 has slots 12, 14 passing therethrough for accommodating therein protrusions 20, 22 extending from an upper side of the retention clip 7. Slots 16, 18, opposed to the slots 12, 14, are for accommodating therein protrusions (not shown) extending from a lower side of the retention clip 7, the lower side of the retention clip 7 being opposed to the upper side of the retention clip 7.

The cover 10 of the male connector assembly 3 has an upper slot 25 passing through an upper side of the cover 10 and a lower slot 27 passing through a lower side of the cover 10. The upper slot 25 is for accommodating therein a protrusion 30 extending from an upper side of the male connector assembly 3. While the lower slot 27 is for accommodating therein a protrusion (not shown) extending from a lower side of the male connector assembly 3. The cover 10 includes an elongated slot 28 extending along an inner surface thereof for accommodating therein an elongated protruding member 29 extending along a side portion of the male connector assembly 3, the elongated slot 28 being used to slidably guide the elongated protruding member 29 when the cover 10 is slidably mounted on an end portion of the male connector assembly 3.

As also illustrated in FIG. 1, the male connector assembly 3 has a lever arm 50 with a fixed end 51 and a free end 52. The free end 52 of the lever arm 50 includes an inner protruding member 54, the inner protruding member 54 having an upper substantially inclined surface 55 and a lower substantially flat surface 56. The fixed end 51 of the lever arm 50 is connected to the lower side of the male connector assembly 3 via a member 53 (generally, an L-shaped member). See, also, FIG. 8.

The retention clip 7 includes a lower side 32 and an upper side 34. An inside portion of the lower side 32 of the retention clip 7 includes an elongated slot 30 which accommodates therein an elongated protrusion (not shown) extending from a lower side of the female connector assembly 5, the elongated slot 30 guiding the elongated protrusion of the female connector assembly 5 when the female connector assembly 5 is inserted into the retention clip 7 once the retention clip 7 is mounted inside the male connector assembly 3. See, also, FIG. 3.

Further, as also illustrated in FIG. 1, the upper side 34 the retention clip 7 includes a pair of flexible fingers 36, 38; namely an inner finger 36 and an outer finger 38, the outer finger 38 having the protrusion 20 thereon (discussed earlier).

As later discussed, when the retention clip 7 is fully inserted and mounted within the male connector assembly 3, the inner protruding member 54 of the free end 52 of the lever arm 50 is placed within a space 60 between end portions of the lower side 32 and the outer finger 38 of the retention clip 7, the inner protruding member 54 of the lever arm 50 being wedged within the space 60 to prevent the outer finger 38 from moving downward (and the protrusions 20, 22 from being dislodged from the slots 12, 14) and to keep the retention clip 7 fully mounted and locked within the male connector assembly 3. Also, the lever arm 50 is kept from moving (and therefore the inner protruding member 54 of the lever arm 50 from moving away from the slot 60) by a bar 62 connected at a side of the male connector assembly 3.

As further shown in FIG. 1, the female connector assembly 5 includes, on an upper surface thereof an elongated slot 40 for accommodating therein the outer finger 38 of the retention clip 7 when the female connector assembly 5 is fully inserted within the retention clip 7, as more fully discussed later.

The connector apparatus position assurance device 8 has leading end members 70, 72; namely, a first leading end member 70 and a second leading end member 72, the first leading end member 70 extending longer from the base end 75 of the connector apparatus position assurance device 8 than the second leading end member 72. As better shown in FIG. 2B and FIG. 2C, the axis of elongation of the second leading end member 72 is positioned below and to the side relative to the axis of elongation of the first leading end member 70.

As further illustrated in FIG. 1, the connector apparatus position assurance device 8 also has an elongated aperture 77 passing through a lower portion thereof, a pair of protrusions 79 extending downward from a bottom elongated member 81 thereof (see, FIG. 2A), and an elongated protrusion 80 extending from a side thereof. When the apparatus position assurance device 8 is inserted into the male connector assembly 3, the elongated protrusion 80 is slidably accommodated and partially guided within a corresponding elongated slot (not shown) within an inner surface of the male connector assembly 3 (more particularly, the inner surface of the lever arm 50 of the male connector assembly 3).

Also, the bottom elongated member 81, below the elongated aperture 77, acts as a flexible cantilever, and flexes when the pair of protrusions 79 slide over the generally L-shaped member 53 when the apparatus position assurance device 8 is inserted into the male connector assembly 3. The pair of protrusions 79, along with the generally L-shaped member 53, act as additional assurance for ensuring that the apparatus position assurance device 8 is securely in place, in final lock position, when fully inserted into the male connector assembly 3.

Figure 2A:
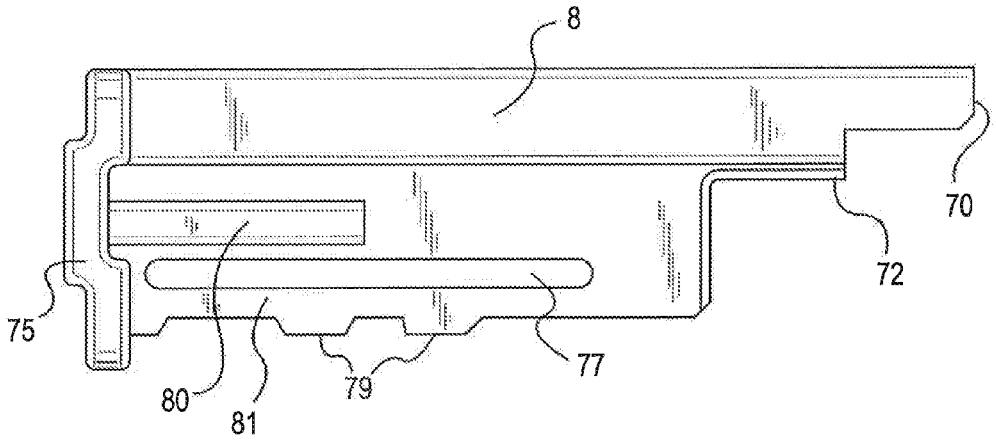
FIG. 2A is side elevation view showing a first side of the connector apparatus position assurance device of the present invention.
Figure 2B:
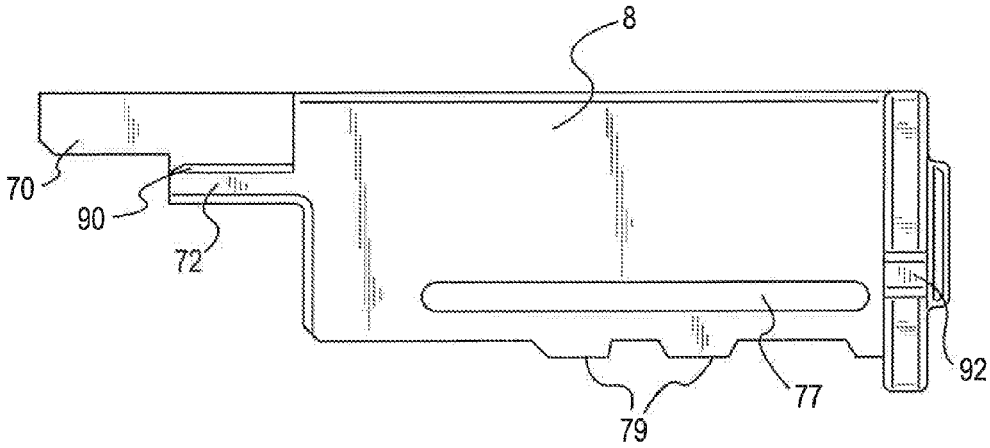
FIG. 2B is a side elevation view showing a second side, opposite the first side, of the connector apparatus position assurance device of the present invention.
Figure 2C:
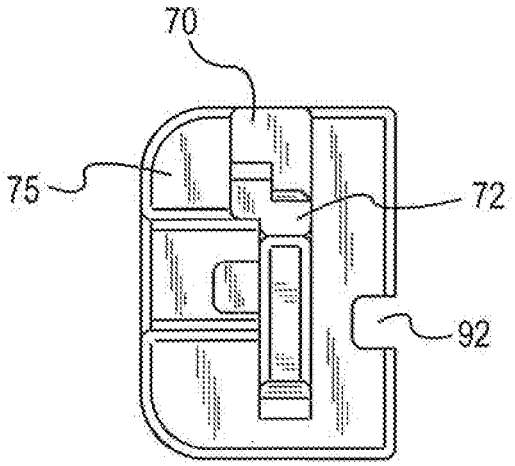
FIG. 2C is an elevation view showing an end side of the connector apparatus position assurance device of the present invention.

FIGS. 2A, 2B, and 2C illustrate the connector apparatus position assurance device 8 of the invention, in more detail, with FIG. 2A being a side elevation view showing a first side of the connector apparatus position assurance device 8, FIG. 2B being a side elevation view showing a second side, opposite the first side, of the connector apparatus position assurance device 8, and FIG. 2C being an elevation view showing an end side of the connector apparatus position assurance device 8. Shown in FIG. 2B is the second leading end member 72 having the axis of elongation being positioned below and to the side relative to the axis of elongation of the first leading end member 70 resulting in a ledge-like surface 90 on an upper surface of the second leading end member 72 (see, FIG. 2B).

Further illustrated in FIG. 2B is a slot 92 formed on a side surface of the base end 75 of the connector apparatus position assurance device 8. The slot 92 (see, also, FIG. 2C), which accommodates therein the elongated protruding member 29 extending along a side portion of the male connector assembly 3, the slot 92 being used to slidably guide the connector apparatus position assurance device 8 when the connector position assurance device 8 is slidably inserted into the male connector assembly 3.

Figure 3:
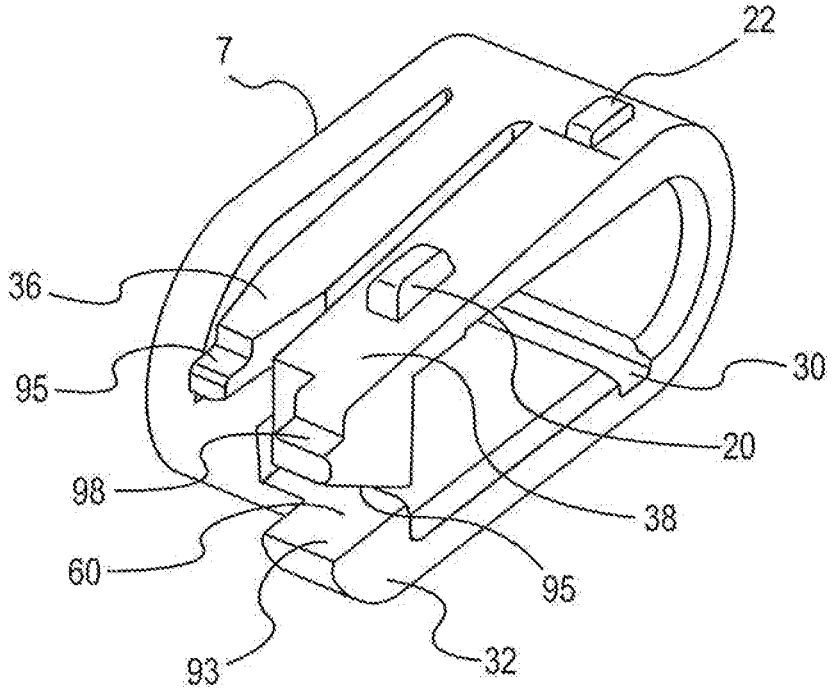
FIG. 3 is a perspective view of a retention clip of the male connector assembly showing the different parts thereof, which affect the insertion of the connector apparatus position assurance device of the present invention.

FIG. 3 illustrates the retention clip 7 having the inner finger 36 and the outer finger 38, both fingers 26, 28 being flexible. When the retention clip 7 is mounted and locked within the male connector assembly 3, the protrusions 20, 22 of the retention clip 7 are accommodated within slots 12, 14, respectively, of the male connector assembly 3, while opposing slots 16, 18 of the male connector assembly 3 accommodate therein protrusions (not shown) extending from a lower side of the retention clip 7, the inner protruding member 54 of the lever arm 50 of the male connector assembly 3 being wedged within the space 60 to prevent the flexible outer finger 38 from moving downward for securing the retainer clip 7 within the male connector assembly 3 by ensuring that the protrusions 20, 22 remain within the slots 12, 14, respectively. The end portion of the lower side 32 has a substantially flat raised portion 93, while the end portion of the outer finger 38 has a sloping portion 95, the substantially flat raised portion 93 and the sloping portion 95 abutting and contacting the lower substantially flat surface 56 and the substantially inclined surface 55, respectively, of the inner protruding member 54 of the free end 52 of the lever arm 50, when the retention clip 7 is mounted and locked within the male connector assembly 3.

The free end portion of the inner finger 36 has a ledge-like member 95, while the free end portion of the outer finger 38 has a ledge-like member 98.

During assembly of the in-line sealed electrical connector apparatus 1, FIGS. 4-7 illustrate the mating of the female connector assembly 5, the retention clip 7, and the connector apparatus position assurance device 8, with the presumption that the retention clip 7 has been mounted within the male connector assembly 3. For clarification, in FIGS. 4-7, the retainer clip 7 is not shown already mounted within the male connector assembly 3 so as to better explain the insertion and locking steps when the female connector assembly 5, the retention clip 7, and the connector apparatus position assurance device 8 achieve full mating and in final lock position. That is, to better understand the mating and locking steps of the female connector assembly 5, the retention clip 7 and the connector apparatus assurance device 8, the illustration of the male connector assembly 3 has been omitted from FIGS. 4-7. In this invention, the retention clip 7 has been pre-mounted and locked, in the manner described above, within the male connector assembly 3 before the female connector assembly 5 is inserted into the retention clip 7 and before the connector apparatus position assurance device 8 is inserted into the male connector assembly 3.

Figure 4:
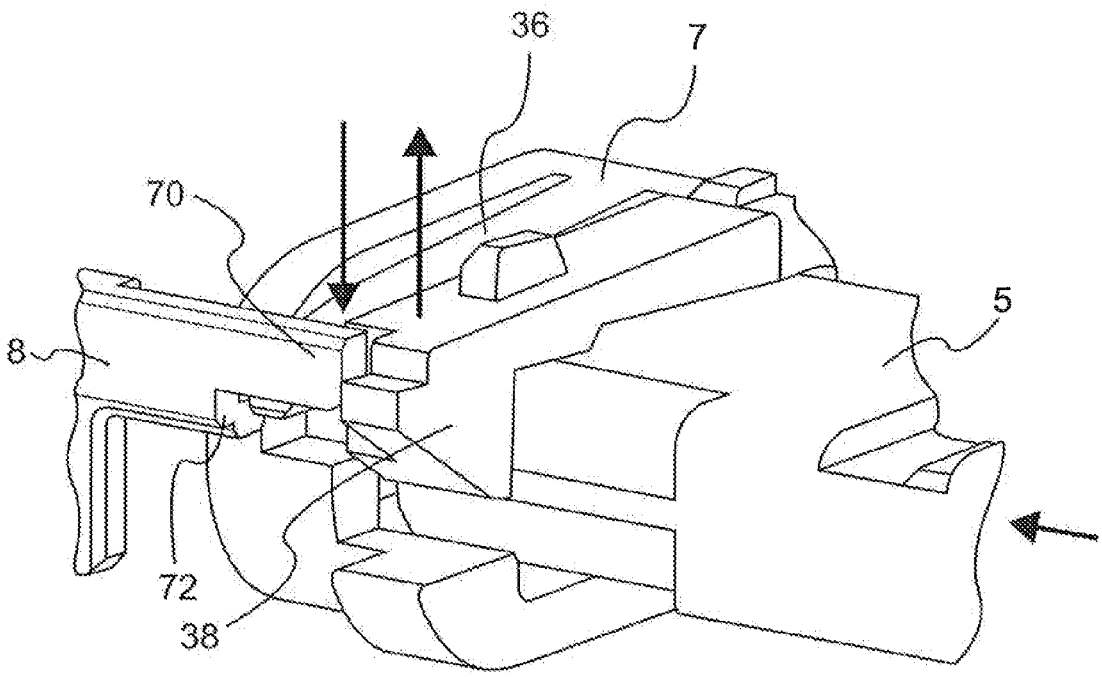
FIG. 4 illustrates a perspective view of the connector apparatus position assurance device, in a pre-lock position, in which a lowered inner retention clip finger and a raised outer retention clip finger Hock the connector apparatus position assurance device from being inserted.

During initial insertion of the connector apparatus position assurance device 8, in the pre-lock position, as shown in FIG. 4, the insertion of the female connector assembly 5 into the retention clip 7 raises the outer finger 38. The raising of the outer finger 38 results in the first leading end member 70 of the connector apparatus position assurance device 8 to be blocked by the end portion of the outer finger 38. Further, the inner finger 36 remains in its lowered position; consequently, the second leading end member 72 of the connector apparatus position assurance device 8 is blocked by the end portion of the inner finger 36. Thus, at initial insertion shown in FIG. 4, the connector apparatus position assurance device 8 remains at a pre-lock position and cannot yet be inserted.

Figure 5:
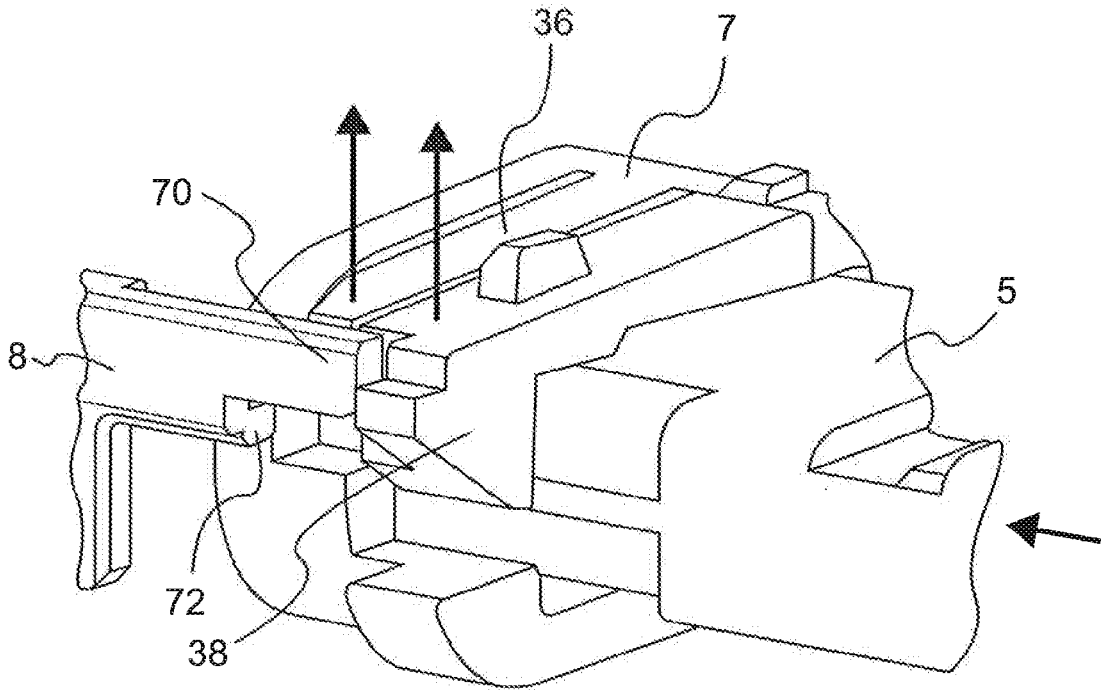
FIG. 5 illustrates a perspective view of the connector apparatus position assurance device, still in a pre-lock position, in which the inner retention clip finger is raised, but the raised outer retention clip finger continues to block the connector apparatus position assurance device from being inserted.

As shown in FIG. 5, when the female connector assembly 5 is further inserted but not yet fully inserted) into the retention clip 7, the leading end portion of the female connector assembly 5 reaches the inner finger 36 and raises the inner finger 36. Consequently, the second leading end member 72 of the connector apparatus position assurance device 8 becomes unblocked. However, because the outer finger 38 remains in a raised position, the first leading end portion 70 of the connector apparatus position assurance device 8 remains blocked. Thus, the connector apparatus position assurance device 8 remains at a pre-lock position and cannot yet be inserted.

Figure 6:
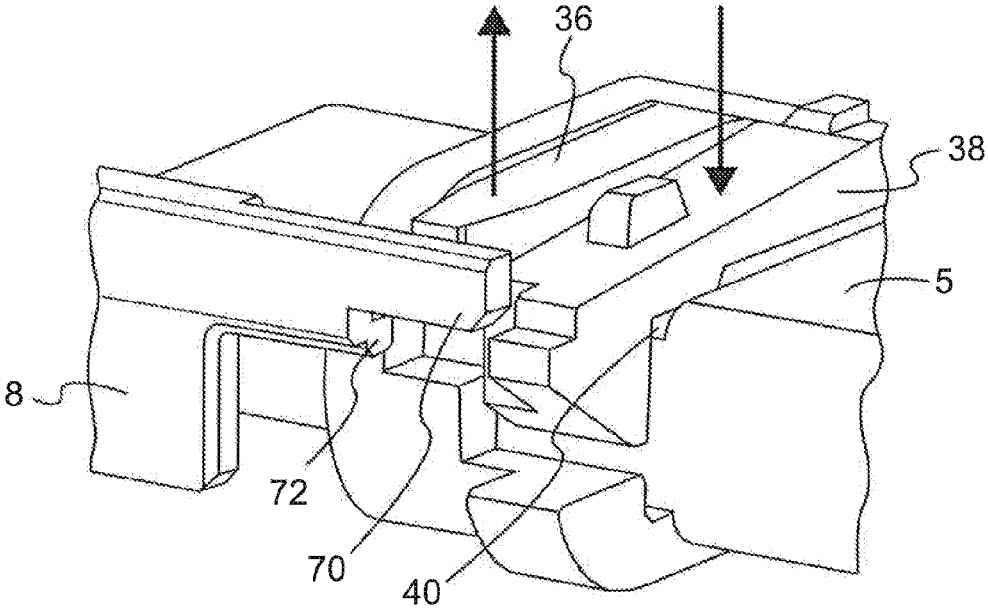
FIG. 6 illustrates a perspective view of the connector apparatus position assurance device in which the inner retention clip finger is raised, while the outer retention clip finger is lowered for allowing the connector apparatus position assurance device to be finally unblocked and ready to be inserted.

In FIG. 6, the female connector assembly 5 has been fully inserted into the retention clip 7. Consequently, the outer finger 38 has dropped into the elongated slot 40 of the female connector assembly 5, thereby lowering the outer finger 38. With the lowered outer finger 38 and with the raised inner finger 36, the first leading end portion 70 and the second leading end portion 72, respectively, of the connector apparatus position assurance device 8 become unblocked, and the connector apparatus position assurance device 8 is set and ready to be inserted.

Figure 7:
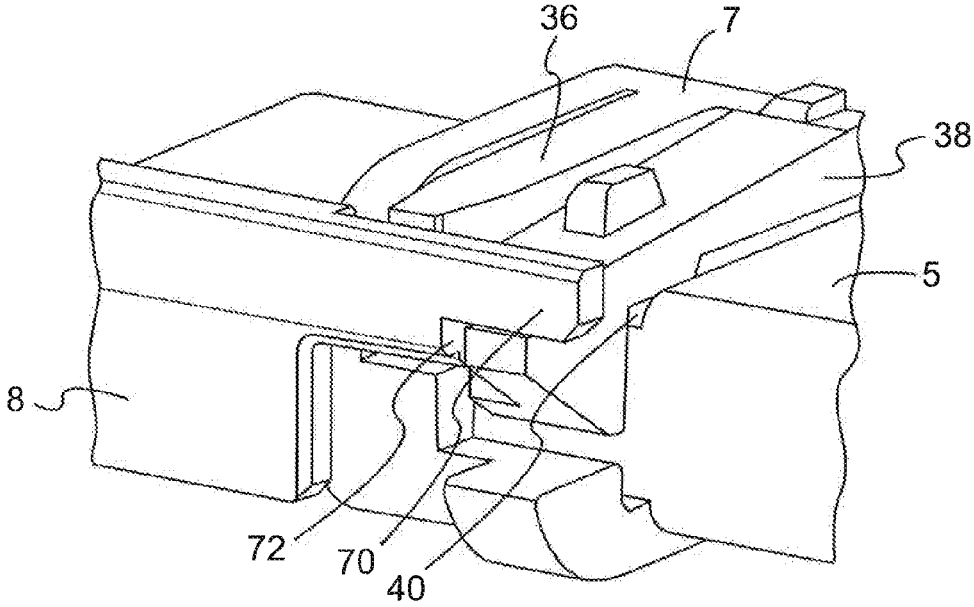
FIG. 7 illustrates a perspective view of the connector apparatus position assurance device a fully inserted position and in a final lock position.

With the female connector assembly 5 fully inserted into the retention clip 7, as shown in FIG. 7, the outer finger 38 is lowered when it drops into the elongated slot 40 of the female connector assembly 5 and the inner finger 36 remains raised, thereby unblocking the first and second leading end portions 70, 72, and allowing the connector apparatus position assurance device 8 to be fully inserted to complete the lock position and be at final lock position.

Figure 8:
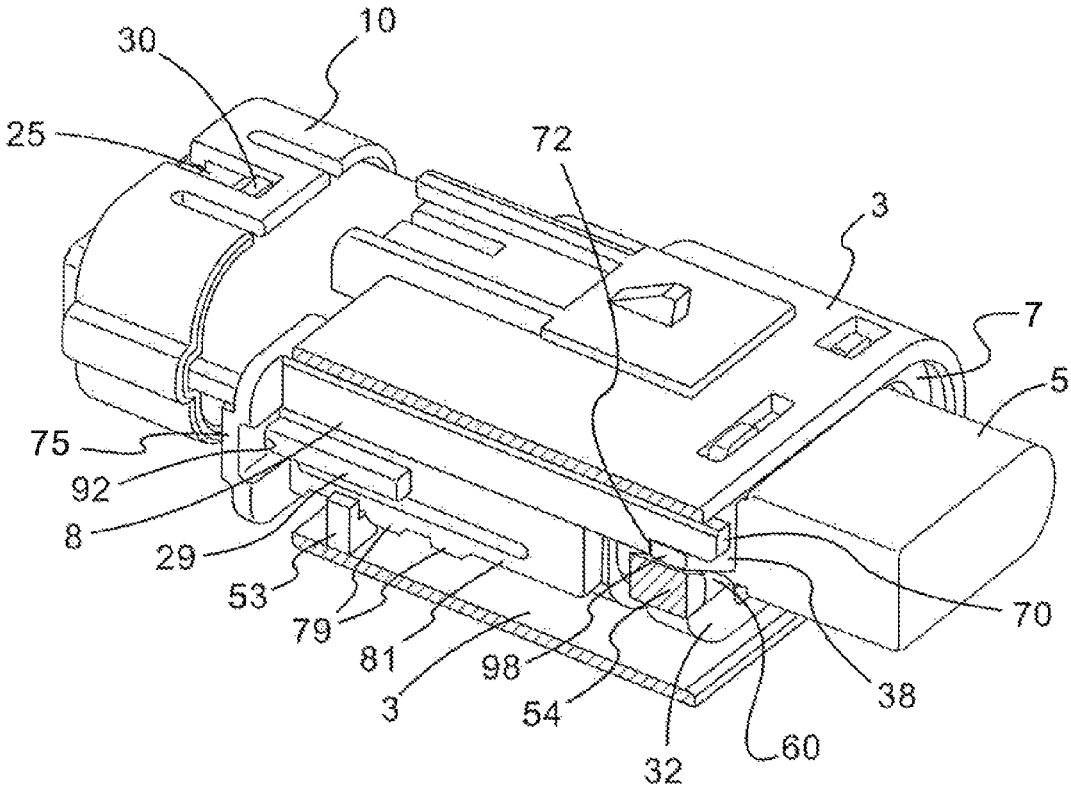
FIG. 8 is a perspective view of the connector apparatus position assurance device, in a full insertion position and final lock position, for completing the locking of the male and female connector assemblies of the in-line sealed electrical connector apparatus of this invention.

FIG. 8 shows the in-line sealed electrical connector apparatus of this invention in which the connector apparatus position assurance device 8 is in final lock position, ready to receive a wire assembly (not shown) to be inserted into the openings (not shown) passing through the cover 10 of the male connector assembly 3 and another wire assembly (not shown) to be inserted into the female connector assembly 5 through openings (not shown) at a free end 6 thereof. As shown in FIG. 8 and as discussed earlier, the retention clip 7 is mounted and kept locked within the male connector assembly 3 with the protrusions 20, 22 of the retention clip 7 being respectively accommodated within the slots 12, 14 of the male connector assembly 3. (Protrusions (not shown) extending from the lower side of the retention clip 7 are similarly accommodated within respective slots 16, 18 (see, FIG. 1) of the male connector assembly In order to more clearly illustrate the connector apparatus position assurance device 8 in its fully inserted position and in complete or final lock position, the illustration of the side portion of the male connector assembly 3 containing the lever arm 50 and the bar 62 of the male connector assembly 3 is omitted in FIG. 8. (Only a cross-section of the inner protruding member 54 of the lever arm 50, discussed earlier, is shown in FIG. 8, positioned within the space 60 between the end portions of the lower side 32 and the outer finger 38 of the retention clip 7.) The connector apparatus position assurance device 8, with its bottom elongated member 81 being seated on the generally L-shaped member 53 extending from the lower side of the male connector assembly 3, is prevented from sliding out by the protrusions 79 and further prevented from moving laterally by its base end 75 being seated via the slot 92 thereof onto the elongated protruding member 29 extending along the side portion of the male connector assembly 3. The first leading end member 70 is seated onto the ledge-like member 98 of the free end portion of the outer finger 38, while the second leading end member 72 abuts a side portion of the free end portion of the outer finger 38. The cover 10 is slidably mounted onto the male connector assembly 3 and locked thereto with the upper protrusion 30 and the lower protrusion (not shown) of the male connecter assembly 3 being respectively accommodated within the upper slot 25 and the lower slot 27 of the cover 10.

As discussed above, the connector apparatus position assurance device 8 of this invention cannot be inserted past the pre-lock position until the female connector assembly 5 has been fully inserted and mated with the male connector assembly 3.

Also, with the in-line sealed electrical connector apparatus 1 of this invention, if the connector apparatus position assurance device 8 happens to be fully inserted and in the final lock position before the female connector assembly 5 is inserted, the first leading end portion 70 of the connector apparatus position assurance device 8 is positioned on the ledge-like member 98 of the free end portion of the outer finger 38 of the retention clip 7. Consequently, the outer finger 38 is at a lowered position, and is prevented from being raised by the first leading end portion 70. Thus, the outer finger 38 blocks the female connector assembly 5 from entering the retention clip 7. In other words, the female connector assembly 5 will detect its inability to be inserted by the inability of the outer finger 38 to be raised upward, for allowing the female connector assembly 5 to be inserted into the retention clip 7, when the connector apparatus position assurance device 8 is in the final lock position.

Moreover, the female connector assembly 5 can only fully mate or inserted into the male connector assembly 3 when the connector apparatus position assurance device 8 is in the above-discussed pre-set position. If for example, a partial or improper mating is achieved (i.e., if the female connector assembly 5 is partially or improperly inserted into the male connector assembly 3, as shown in FIG. 4 or FIG. 5), the connector apparatus position assurance device 8 cannot move forward or inserted because either the inner finger 36 has not been raised for allowing the second leading end member 72 of the retention clip 7 to be unblocked or the outer finger 38 has not been lowered for allowing the first leading end member 70 to be unblocked. Only when the female connector assembly 5 has fully mated or inserted into the male connector assembly 3 has occurred will the connector apparatus position assurance device 8 be allowed to be fully moved forward or inserted because the inner finger 36 has been raised for unblocking the second leading end member 72 of the retention clip 7 and the outer finger 38 has been lowered for unblocking the first leading end member 70 of the retention clip 7, as shown in FIGS. 6, 7 and 8), thereby having the connector apparatus position assurance device 8 to be in final lock position.

The present invention is not limited to the above-described embodiments; and various modifications in design, structural arrangement or the like may be used without departing from the scope or equivalents of the present invention.

We claim:

1. An in-line sealed electrical connector apparatus, comprising:

a male connector assembly having a retention clip mounted therein;

a female connector assembly mounted within said retention clip; and a connector apparatus position assurance device insertable into said male connector assembly and said retention clip, wherein said connector apparatus position assurance device, when in a full lock position, assures a mating position of said male and female connector assemblies.

2. The in-line sealed electrical connector apparatus according to claim 1, further comprising:

a cover slidably mounted onto an end portion of said male connector assembly;

a wire assembly insertable into the end portion of said male connector assembly; and another wire assembly insertable into an end portion of said female connector assembly.

3. An in-line sealed electrical connector apparatus, comprising:

a male connector assembly, said male connector assembly including a retention clip, wherein said retention clip includes a flexible inner finger and a flexible outer finger;

a female connector assembly mounted within said retention clip, wherein said female connector assembly having an elongated slot for accommodating therein said outer finger of said retention clip when said female connector assembly is mounted therein; and a connector apparatus position assurance device insertable into said male connector assembly and said retention clip, wherein said connector apparatus position assurance device, when in a full lock position, assures a mating position of said male and female connector assemblies, wherein said connector apparatus position assurance device comprises:

a first leading end portion having a first axis of elongation; and a second leading end portion having a second axis of elongation.

4. The in-line sealed electrical connector apparatus according to claim 3, wherein said second axis of elongation of said second leading end member is positioned below and to a side relative to said first axis of elongation of said first leading end member.

5. The in-line sealed electrical connector apparatus according to claim 4, wherein said first and second leading end members interact with said inner and outer flexible fingers of said male connector assembly when said connector apparatus position assurance device is inserted therein.

6. The in-line sealed electrical connector apparatus according to claim 5, wherein said connector apparatus position assurance device further includes an elongated protrusion on a side thereof, said elongated protrusion being accommodated within a corresponding slot within an inner surface of said male connector assembly when said connector apparatus position assurance device is inserted therein.

7. The in-line sealed electrical connector apparatus according to claim 6, wherein said connector apparatus position assurance device further includes a bottom elongated member having at least one protrusion extending therefrom, wherein said protrusion at least partially secures said connector apparatus position assurance device within said male connector assembly.

8. The in-line sealed electrical connector apparatus according to claim 7, wherein said connector apparatus position assurance device further includes a base end, said base end having a slot for accommodating therein an elongated protruding member extending along a side portion of said male connector assembly and for slidably guiding the connector apparatus position assurance device when inserted into said male connector assembly and said retention clip.

9. A method for assuring a locking connection position for male and female connector assemblies of an in-line sealed electrical connector apparatus, comprising the steps of:

inserting said female connector assembly into a retention clip of said male connector assembly; and inserting a connector apparatus position assurance device into said male connector assembly and said retention clip for assuring the locking connection position for said male and female connector assemblies.

10. The method according to claim 9, wherein said step of inserting said female connector includes the steps of:

raising an outer finger of said retention clip, raising an inner finger of said retention clip, and thereafter lowering said outer finger of said retention clip to thereby allow said connector apparatus position assurance device to be slidably inserted into said male connector assembly and said retention clip in a full lock position for assuring the locking connection position for said male and female connector assemblies.

11. The method for locking connection positions for male and female connector assemblies of an in-line sealed electrical connector apparatus, comprising the steps of:

partially inserting said female connector assembly into a retainer clip of said male connector assembly;

inserting, in a pre-lock position, a connector apparatus position assurance device into said male connector assembly and said retention clip;

fully inserting said female connector assembly into said retention clip; and thereafter, fully inserting, in a full lock position, said connector apparatus position assurance device into said retention clip for assuring the locking connection positions for said male and female connector assemblies.

12. The method according to claim 11, wherein said step of partially inserting said female connector assembly includes the step of raising an outer finger of said retention clip.

13. The method according to claim 11, wherein said step of partially inserting said female connector assembly includes the steps of raising an outer finger and an inner finger of said retention clip.

14. The method according to claim 13, wherein said step of fully inserting said female connector assembly includes the step of lowering the outer finger of said retention clip.

* * * * *